US007677484B2

(12) United States Patent
Dallimore et al.

(10) Patent No.: US 7,677,484 B2
(45) Date of Patent: Mar. 16, 2010

(54) WEAR PART FOR A CRUSHER

(75) Inventors: Rowan Dallimore, Radstock (GB); George Fensome, Bristol (GB); Björn Lovén, Malmö (SE); Sven-Henrik Norman, Blentarp (SE)

(73) Assignee: Sandvik Intellectual Proerty AB, Sandviken (SE)

( * ) Notice: Subject to any disclaimer, the term of this patent is extended or adjusted under 35 U.S.C. 154(b) by 947 days.

(21) Appl. No.: 10/525,978

(22) PCT Filed: Aug. 27, 2003

(86) PCT No.: PCT/SE03/01318

§ 371 (c)(1),
(2), (4) Date: Jul. 29, 2005

(87) PCT Pub. No.: WO2004/020101

PCT Pub. Date: Mar. 11, 2004

(65) Prior Publication Data

US 2006/0011762 A1 Jan. 19, 2006

(30) Foreign Application Priority Data

Aug. 28, 2002 (SE) ..... 0202533

(51) Int. Cl.
*B02C 7/00* (2006.01)
*B02C 7/12* (2006.01)
*B02C 17/20* (2006.01)

(52) U.S. Cl. ..... 241/275; 241/285.1; 241/301

(58) Field of Classification Search ..... 241/275, 241/285.1, 301
See application file for complete search history.

(56) References Cited

U.S. PATENT DOCUMENTS

| | | | | |
|---|---|---|---|---|
| 3,154,259 | A | 10/1964 | Behnke et al. | |
| 3,727,127 | A | 4/1973 | Heidenwolf | |
| 3,767,127 | A | 10/1973 | Wood | |
| 3,881,664 | A * | 5/1975 | Bowling et al. | 241/275 |
| 4,690,341 | A | 9/1987 | Hise et al. | |
| 4,923,131 | A * | 5/1990 | Rossouw et al. | 241/275 |
| 5,037,035 | A | 8/1991 | Garland | |
| 5,145,279 | A * | 9/1992 | Larcheron et al. | 405/50 |
| 5,366,170 | A * | 11/1994 | Jones et al. | 241/275 |
| 6,227,473 | B1 * | 5/2001 | Arnold | 241/285.1 |

FOREIGN PATENT DOCUMENTS

| | | |
|---|---|---|
| EP | 0 429 298 A2 | 5/1991 |
| WO | WO 01/30501 A1 | 5/2001 |

OTHER PUBLICATIONS

International-Type Search Report for National Appl. No. SE 0202533-6 dated Mar. 19, 2003.

* cited by examiner

*Primary Examiner*—Bena Miller
(74) *Attorney, Agent, or Firm*—Drinker Biddle & Reath LLP

(57) ABSTRACT

A distributor plate adapted to be releasably mounted on a horizontal lower disc of a rotor of a vertical shaft impact crusher. The rotor has an opening for the intake of material to be crushed and at least one outflow opening for material leaving the rotor. The distributor plate is an equilateral polygon as seen from above.

19 Claims, 6 Drawing Sheets

V-V

VII

WEAR PART FOR A CRUSHER

TECHNICAL FIELD OF THE INVENTION

The present invention relates to a distributor plate adapted to be releasably mounted on a horizontal lower disc of a rotor of a vertical shaft impact crusher, said rotor having an opening for the intake of material to be crushed and at least one outflow opening for material leaving the rotor.

The present invention also relates to a rotor for a vertical shaft impact crusher, the rotor having an opening for the intake of material to be crushed, at least one outflow opening for material leaving the rotor, and at least one lower wear plate and a distributor plate releasably mounted on a horizontal lower disc of the rotor.

BACKGROUND ART

Vertical shaft impact crushers (VSI-crushers) are used in many applications for crushing hard material like rocks, ore etc. U.S. Pat. No. 3,154,259 describes a VSI-crusher comprising a housing and a horizontal rotor located inside the housing. Material that is to be crushed is fed into the rotor via an opening in the top thereof. With the aid of centrifugal force the rotating rotor ejects the material against the wall of the housing. On impact with the wall the material is crushed to a desired size. The housing wall could be provided with anvils or have a bed of retained material against which the accelerated material is crushed.

The rotor of a VSI-crusher usually has a horizontal upper disc and a horizontal lower disc. The upper and lower discs are connected with a vertical rotor wall. The upper disc has an aperture for feeding material into the rotor. The material lands on the lower disc and is then thrown out of the rotor via openings in the rotor wall.

The material exerts an impact force and wear on the lower disc. To ensure a long life of the lower disc it is usually provided with a distributor plate. The distributor plate, which is located at the centre of the lower disc, is made from a material that is resistant to impact and wear.

In U.S. Pat. No. 3,767,127 to Wood a deflection disc assembly is described. The deflection disc has an outer ring and a core member. A central stud passing through the core member and threadedly engaged to the rotor shaft holds the deflection disc in position in the rotor.

U.S. Pat. No. 4,690,341 to Hise describes a flat centre wear plate which is fixed to the rotor shaft by a bolt.

WO 01/30501 describes a distributor comprising a first part having an inclined surface and a second part with a flat surface. A bolt holds the first and second parts fixed to a rotor shaft.

The distributor plates described above do not have a very long life and cause a rather long down time when they need to be replaced. To make it possible for a person working with the rotor to replace the distributor plate it is often necessary to dismantle the top of the rotor.

SUMMARY OF THE INVENTION

It is an object of the present invention to provide a distributor plate which has a longer life and which decreases the down time required for maintenance of the rotor.

This object is achieved with a distributor plate according to the preamble and characterised in that the distributor plate is an equilateral polygon as seen from above.

An advantage with this distributor plate is that its life is greatly increased. The polygonal shape provides straight side edges which decrease the wear, particularly at the periphery of the distributor plate. A possible explanation is that much of the wear at the periphery of the distributor plate may be caused by dust loaded air streams circulating inside the rotor. Those air streams may be hindered by the straight side edges thus reducing the wear. A polygon has several straight side edges and would thus be able to efficiently hinder any dust loaded air streams.

Preferably the distributor plate has a shape chosen among triangular, square, hexagonal, octagonal and nonagonal shapes. An advantage with these particular shapes is that they are particularly efficient in hindering dust loaded air streams from circulating inside the rotor. In particular the hexagonal, octagonal and nonagonal shapes are also very robust to large pieces of material impacting the distributor plate. Still more preferably said polygon is an equilateral polygon, the number of sides of the polygon being chosen such that the number of sides is 1, 2 or 3 times the number of outflow openings of the rotor to which the distributor plate is to be mounted. An equilateral polygon makes it easier to balance the rotor. The distributor plate should have at least one side edge corresponding to each outflow opening of the rotor. If the number of sides of the distributor plate is 2 or 3 times the number of outflow openings it is possible to turn the distributor plate after some time in operation such that the sides being adjacent to the outflow openings is changed. Thus the life of the distributor plate is prolonged. Preferably the number of sides is 2 times the number of outflow openings of the rotor. This design has proven to give both a long life, possibly due to the fact that such a number of sides are especially efficient in hindering the rotating air streams inside the rotor, and the possibility to turn the distributor plate after some time of operation to further increase its life.

Preferably at least one straight side edge of the distributor plate is adapted to be parallel to an outflow direction of material leaving the rotor and to be parallel and adjacent to a face of a lower wear plate protecting the lower disc from wear. This design has proven to give a long life for both the distributor plate, the lower wear plate and the lower disc due to the fact that swirling of dust loaded air streams on the lower wear plate and on the lower disc is efficiently prevented by the distributor plate when located in this relation to the lower wear plate and to the direction of material leaving the rotor. It is also easy to make the distributor plate fit with a horizontal wear plate extending from a position close to the centre of the rotor and towards the outflow opening.

According to a preferred embodiment the distributor plate at the centre of its lower face has a recess adapted to make the distributor plate horizontally turnable around a vertical shaft mounted on the lower disc, such that the position of the distributor plate in relation to the lower disc may be adjusted before mounting the distributor plate. The recess makes it easy to centre the distributor plate on the rotor. After centring the distributor plate it may be turned around the shaft until the correct position of the edge/-s is obtained, the distributor plate still being safely centred. It also becomes easy to turn the distributor plate to some degree after it has become worn. This makes it possible to quickly turn the distributor plate to a new position without having to dismount the rotor. Thus maintenance stops become quick and efficient. Still more preferably the recess extends only through a part of the thickness of the distributor plate, the upper face of the distributor plate thus being unaffected by said recess. An advantage with this design is that the upper surface of the distributor plate obtains a much better impact and wear resistance since it is unbroken. The central part of the distributor plate is exposed both to heavy impact wear and possibly also to wear caused by dust loaded air streams circulating inside the rotor. The risk of rocks breaking a central bolt and the risk of an excessive wear of a central bolt or of a cap protecting a central bolt is thus avoided with the design of the present invention. Also it becomes easier to manufacture the distributor plate with the unbroken upper surface, in particular if the upper surface is to be provided with a layer of extra resistant material.

Preferably the upper face of the distributor plate comprises an unbroken layer of a hard metal, such as tungsten carbide. Such a layer of hard metal will substantially prolong the life of the distributor plate and thus decrease maintenance costs.

According to a preferred embodiment the distributor plate comprises mounting means located at a vertical side edge of the distributor plate and adapted for the mounting of a vertical support fixing the distributor plate to the lower disc of the rotor. An advantage with such mounting means is that they do not interact with the upper surface of the distributor plate. Another advantage is that the distributor plate will provide some protection for the mounting means located below the actual material flow. The mounting means may also be fitted and removed without having to lift the entire distributor plate.

It is another object of the present invention to provide a rotor which require less down time for maintenance.

This object is achieved with a rotor according to the preamble and characterised in that the distributor plate is an equilateral polygon as seen from above, at least one straight side edge of the distributor plate being parallel to an outflow direction of material leaving the rotor and being parallel to and adjacent to a face of the lower wear plate.

An advantage of this rotor is that the polygonal shape of the distributor plate decreases the wear inside the rotor and thus maintenance stops may be made less frequently. The straight side edge of the distributor plate fit with the adjacent and parallel face of the wear plate to hinder any wear at the underlying lower disc of the rotor.

These and other aspects of the invention will be apparent from and elucidated with reference to the embodiments described hereafter.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
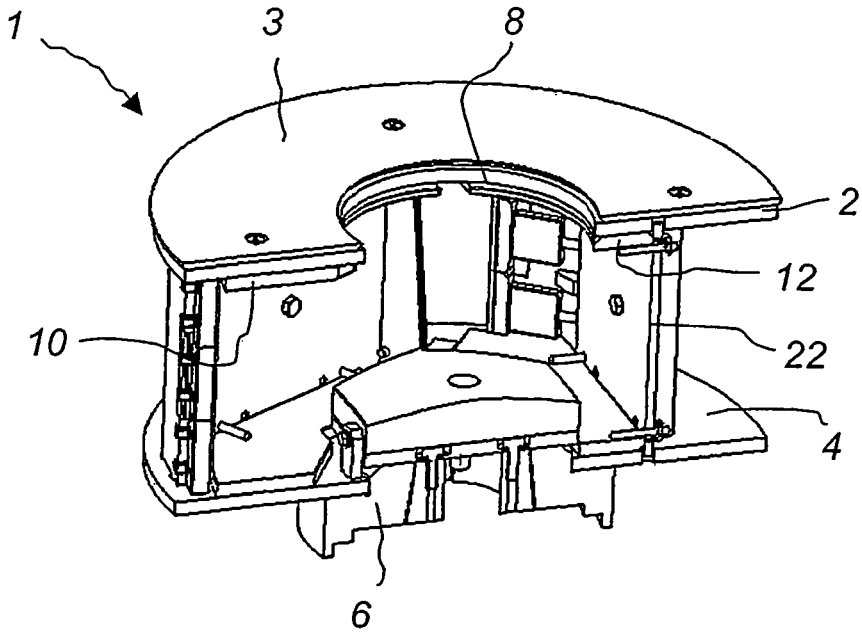
FIG. 1 is three-dimensional section view and shows a rotor for a VSI-crusher

FIG. 1 shows a rotor 1 for use in a VSI-crusher. The rotor 1 has a roof in the form of an upper disc 2 having a top wear plate 3 and a floor in the form of a lower disc 4. The lower disc 4 has a hub 6, which is welded to the disc 4. The hub 6 is to be connected to a shaft (not shown) for rotating the rotor 1 inside the housing of a VSI-crusher.

Figure 2:
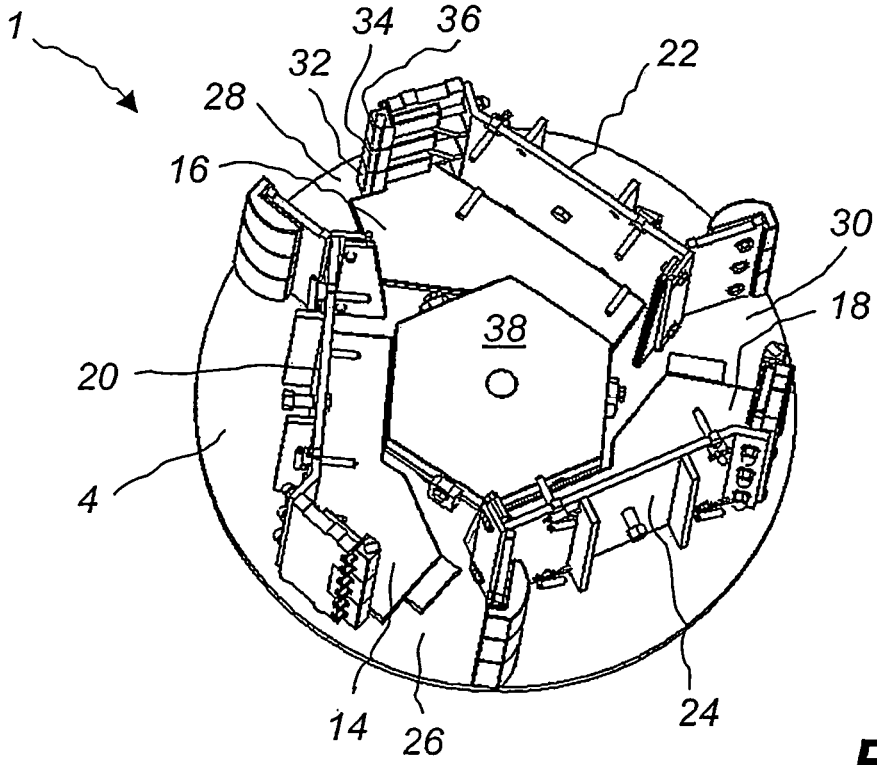
FIG. 2 is a three-dimensional view and shows the rotor of FIG. 1 with the upper disc removed.

The upper disc 2 has a central opening 8 through which material to be crushed can be fed into the rotor 1. The upper disc 2 is protected from wear by upper wear plates 10 and 12. The upper disc 2 is protected from rocks impacting the rotor 1 from above by the top wear plate 3. As is better shown in FIG. 2 the lower disc 4 is protected from wear by three lower wear plates 14, 16 and 18.

The upper and lower discs 2, 4 are separated by and held together by a vertical rotor wall which is separated into three wall segments 20, 22 and 24. The gaps between the wall segments 20, 22, 24 define outflow openings 26, 28, 30 through which material may be ejected against a housing wall.

At each outflow opening 26, 28, 30 the respective wall segment 20, 22, 24 is protected from wear by three wear tips 32, 34, 36 located at the trailing edge of the respective wall segment 20, 22, 24.

A distributor plate 38 is fastened to the centre of the lower disc 4. The distributor plate 38 distributes the material that is fed via the opening 8 in the upper disc 2 and protects the lower disc 4 from wear and impact damages caused by the material fed via the opening 8.

Figure 3:
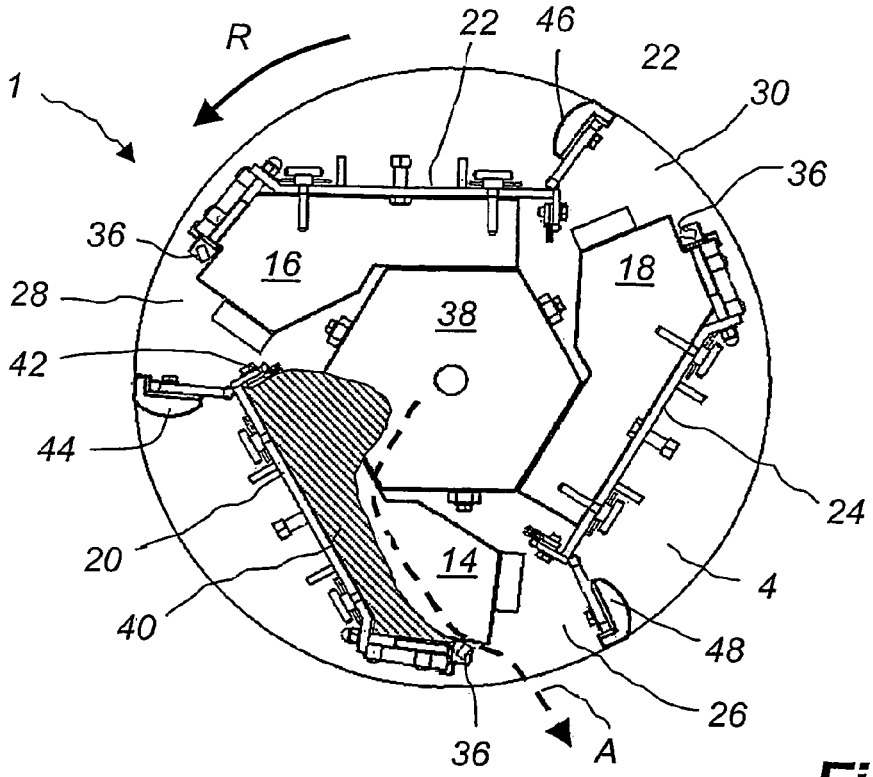
FIG. 3 shows the view of FIG. 2 as seen from above in a two dimensional perspective.

During operation of the rotor 1 a bed 40 of material is built up inside the rotor 1 against each of the three wall segments 20, 22, 24. In FIG. 3 only the bed 40 located adjacent to the wall segment 20 is shown. The bed 40, which consists of material that has been fed to the rotor 1 and then has been trapped inside it, extends from a rear support plate 42 to the wear tips 32, 34, 36. The bed 40 protects the wall segment 20 and the wear tips 32, 34, 36 from wear and provides a proper direction to the ejected material. The dashed arrow A describes a typical passage of a piece of rock fed to the rotor 1 via the central opening 8 and ejected via the outflow opening 26. The arrow R indicates the rotational direction of the rotor 1 during operation of the VSI-crusher.

Each wall segment 20, 22, 24 is provided with a cavity wear plate 44, 46, 48, each preferably having three cavity wear plate portions. The cavity wear plates 44, 46, 48 protect the rotor 1 and in particular the wear tips 32, 34, 36 from material rebounding from the housing wall and from ejected material and airborne fine dust spinning around the rotor 1.

Figure 4:
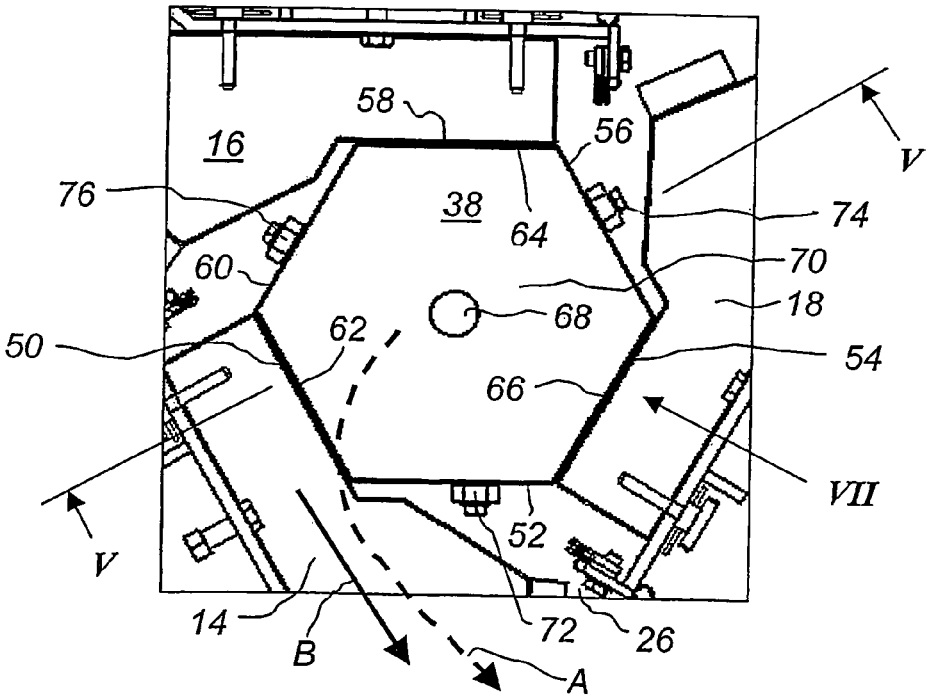
FIG. 4 is an enlargement of the central portion of FIG. 3 and shows a distributor plate.

In FIG. 4 the regularly hexagonal shape of the distributor plate 38 is shown in greater detail. The distributor plate 38 has six equilateral, vertical side edges 50, 52, 54, 56, 58, 60. The side edge 50 is substantially parallel to the outflow direction B of the material leaving the rotor 1 via the outflow opening 26. The side edge 50 is also parallel and adjacent with the face 62 of the wear plate 14. In a similar way the side edge 58 is adjacent to the face 64 of the wear plate 16 and the side edge 54 is adjacent to the face 66 of the wear plate 18. The distributor plate 38 has a central flat area 68 from which a sloped surface 70 of the distributor plate 38 extends towards the side edges 50, 52, 54, 56, 58 and 60.

The distributor plate 38 is removably fixed to the lower disc 4 with the help of three vertical supports 72, 74, 76 fitted to the side edges 52, 56, 60 that are not adjacent to a face of a wear plate. Thus the vertical supports 72, 74, 76 are located at some distance from the typical rock passage indicated with the arrow A.

Figure 5:
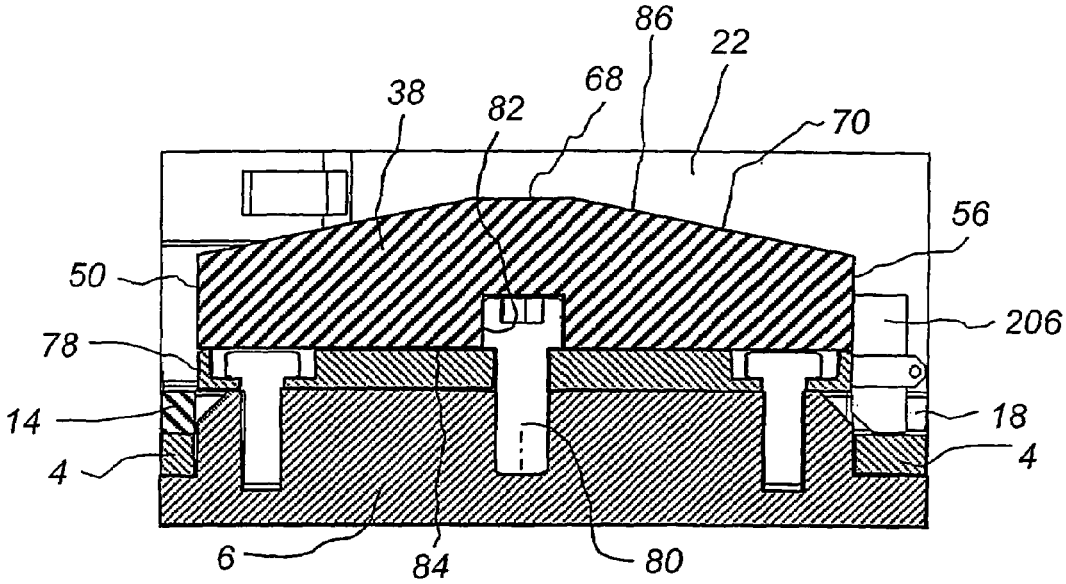
FIG. 5 is a sectional view along the line V-V of FIG. 4.

As is shown in FIG. 5 the distributor plate 38 rests on a mounting plate 78. The mounting plate 78 has the same hexagonal shape as the distributor plate 38 as seen from above. The mounting plate 78 is bolted to the hub 6 and thus to the lower disc 4. A vertically mounted central bolt 80 extending through the mounting plate 78 is bolted at the centre of the hub 6. The distributor plate 38 has a central cylindrical recess 82 at its lower face 84. The diameter and depth of the recess 82 is adapted to house the circular top of the bolt 80 such that the bolt 80 centres the distributor plate 38 on the lower disc 4. The lower face 84 of the distributor plate 38 may slide on the upper surface of the mounting plate 78 when a locking member 206 according to an alternative embodiment of a vertical support described below has been removed. The lower surface 84 of the distributor plate 38 is located at a higher level than the upper surfaces of the wear plates 14, 16, 18. Thus it is possible to turn the distributor plate 38 on the mounting plate 78 without removing the wear plates 14, 16, 18.

Figure 6:
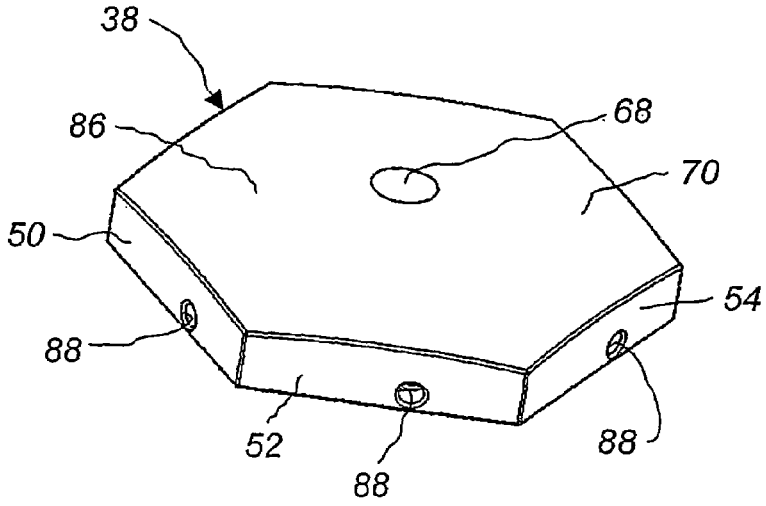
FIG. 6 is a three-dimensional view of the distributor plate.
Figure 7:
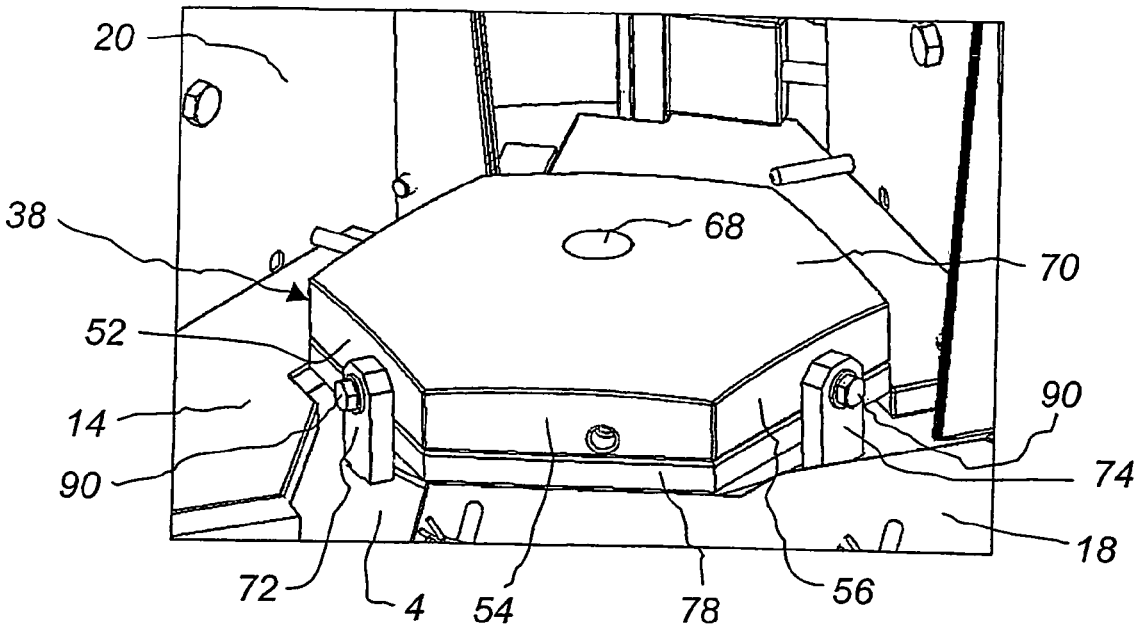
FIG. 7 is a three-dimensional view as seen along the arrow VII of FIG. 4.

The flat area 68 and the sloped surface 70 together form an unbroken upper surface 86 of the distributor plate 38 as indicated in FIG. 6. The distributor plate 38 shown in FIG. 6 is made entirely from white iron. Each vertical side edge 50, 52, 54, 56, 58,. 60 has a mounting means in the form a of a hole 88 as shown in FIG. 6. The hole 88 may be provided with an inner thread to receive a bolt 90 forming part of the support 72, 74 and 76 respectively, as seen in FIG. 7. As is shown in FIG. 7 the supports 72, 74, 76 are fitted in slots in the lower disc 4 and bolted to the distributor plate 38 with the help of the bolts 90 thus holding the distributor plate 38 in place.

The mounting of the distributor plate 38 is performed by lowering it such that the recess 82 engages the top of the bolt 80. The distributor plate 38 is then turned in the horizontal plane until the side edges 50, 54 and 58 have the proper position in relation to the wear plates 14, 16, 18. The supports 72, 74, 76 are mounted to the distributor plate 38 such that it becomes fixed to the lower disc 4.

After some time of operation of the rotor 1 the distributor plate 38 has been subjected to some wear. The wear pattern often has a certain relationship with the outflow openings, such that the maximum wear often occurs at the side edges 50, 54, 58 being adjacent to a horizontal wear plate. The supports 72, 74, 76 are dismounted. The distributor plate 38 is now turned horizontally, thus sliding on the upper surface of the mounting plate 78, until the side edge 52 is adjacent to the face 62 of the wear plate 14, the side edge 56 being adjacent to the face 66 of the wear plate 18 and so on. The supports 72, 74, 76 are mounted again and the rotor 1 is ready for operation. Thus it is possible to prolong the life of the distributor plate 38 by simply turning it 60° in the horizontal plane after some time of operation. At the turning sequence the distributor plate 38 need not be lifted, since it simple slides on the mounting plate 78. The turning thus becomes very quick and easy to perform.

Figure 8:
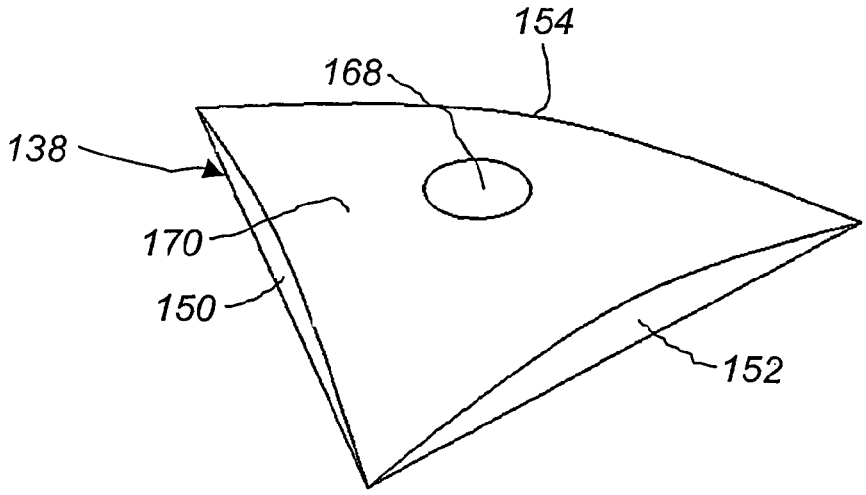
FIG. 8 is a three-dimensional view of a distributor plate according to a second embodiment of the invention.

In FIG. 8 another embodiment of the invention is shown. The main difference compared to the distributor plate 38 is that this embodiment is a distributor plate 138 in the form of an equilateral triangle. The distributor plate 138 has a central flat area 168 from which a sloped surface 170 extends towards the three vertical side edges 150, 152, 154. Each of the three vertical side edges 150, 152, 154 is adapted to be located adjacent to a face of a wear plate. The distributor plate 138 is thus adapted for mounting at a rotor having three outflow openings.

Figure 9:
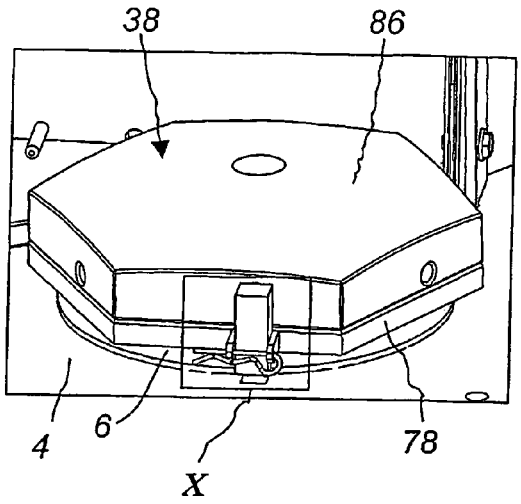
FIG. 9 is a three-dimensional view and shows an alternative way of releasably fixing the distributor plate.
Figure 10:
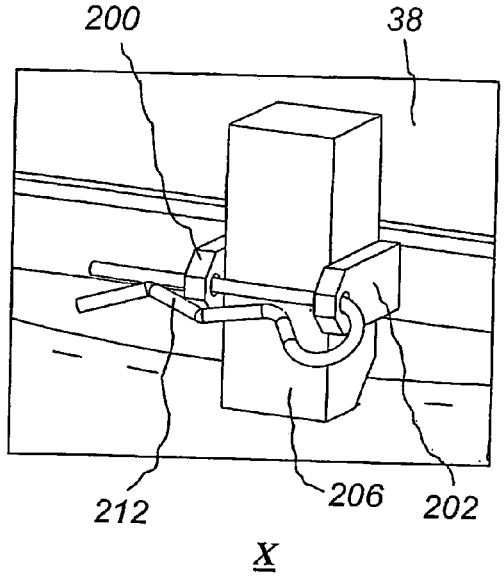
FIG. 10 is an enlargement of the area X shown in FIG. 9.
Figure 11:
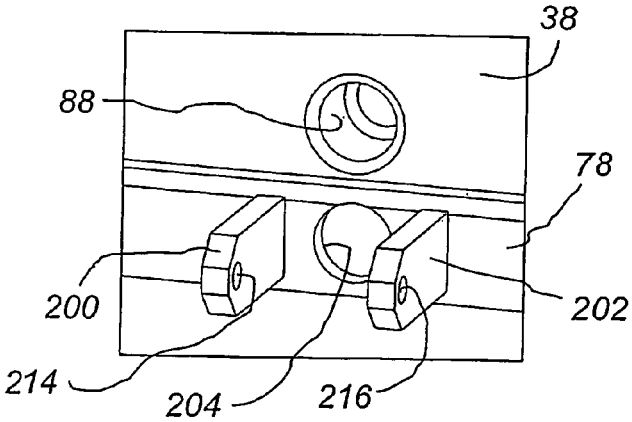
FIG. 11 shows the distributor plate before being secured to the mounting plate.
Figure 12:
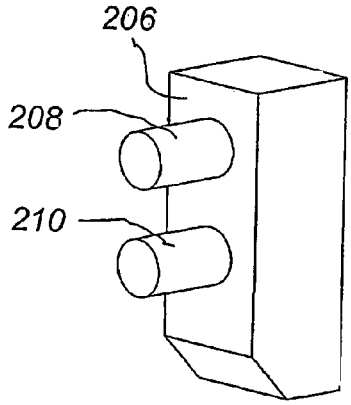
FIG. 12 shows a locking member for securing the distributor plate to the mounting plate.

In FIG. 9 to 12 an alternative embodiment of the fixing of the distributor plate 38 is shown. The mounting plate 78 is provided with a pair of lugs 200, 202 and a round mounting hole 204 as is better shown in FIG. 11. A vertical support in the form of a locking member 206, shown in FIG. 12, is provided with an upper pin 208 and a lower pin 210. The upper pin 208 fits into the hole 88, which need not be threaded, of the distributor plate 38 and the lower pin 210 fits into the mounting hole 204 of the mounting plate 78. A spring dowel pin 212 is inserted via holes 214, 216 in the lugs 200, 202 to lock the locking member 206 in its proper position. The locking member 206 thus fixes the distributor plate 38 to the mounting plate 78. The locking member 206 is easily mounted by just inserting its pins 208, 210 into the hole 88 and the mounting hole 204 respectively followed by insertion of the spring dowel pin 212 such that it locks the locking member 206. The above described embodiment provides for very quick mounting or turning of the distributor plate 38. Preferably pairs of lugs 200, 202 are located at those sides of the mounting plate 78 that are located at some distance from a rock passage, such as the rock passage indicated with the arrow A in FIG. 3. Thus the wear on the locking member 206 is minimized. As indicated in FIG. 9 and FIG. 10 the upper part of the locking member 206 is located below the upper surface 86 of the distributor plate 38. Thus the feed material flowing over the upper surface 86 of the distributor plate 38 will flow over the locking member 206 without causing any substantial wear to it.

Figure 13:
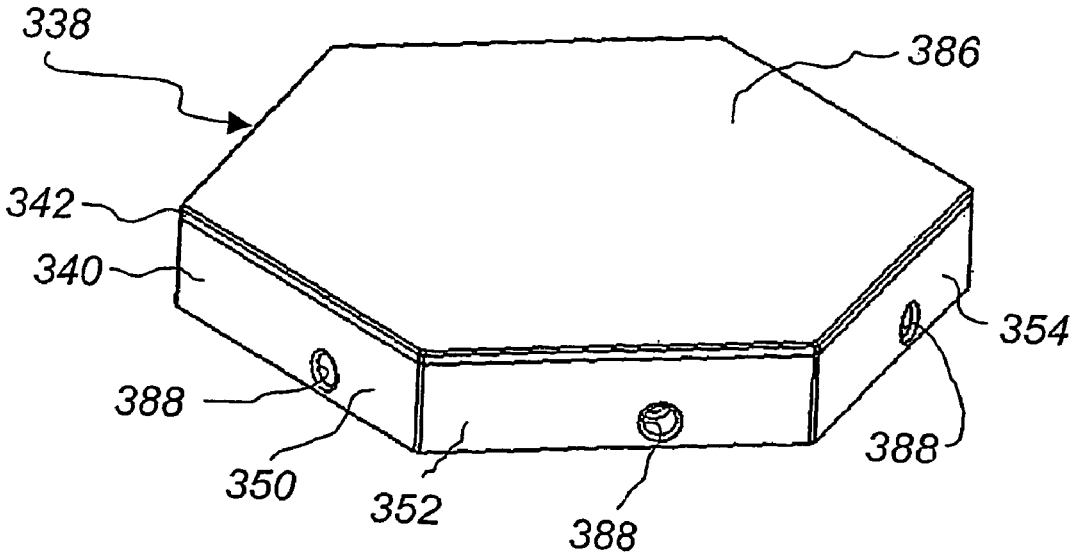
FIG. 13 is a three-dimensional view of a distributor plate according to a third embodiment of the invention.

FIG. 13 shows a third embodiment of the invention. A hexagonal distributor plate 338 shown in FIG. 13 has vertical side edges 350, 352, 354 and holes 388 that are similar to the vertical side edges 50, 52, 54 and holes 88 respectively of the distributor plate 38 described above. The upper surface 386 of the distributor plate 338 is flat. The distributor plate 338 comprises a base layer 340 made from a flat sheet of a hard steel. A top layer 342 of a hard metal, such as tungsten carbide, has been coated on the flat upper surface of the base layer 340. The distributor plate 338 having the top layer 342 made of tungsten carbide has very good resistance to wear and impact and will have a very long life. The flat upper surface of the base layer 340 makes the tungsten carbide layer 342 easy to apply to the base layer 340. The fact that the upper surface 386 of the tungsten layer 342 will be flat as well also contributes to making the application of the tungsten layer 342 simple. The distributor plate 338 has a recess (not shown in FIG. 13) which is similar to the recess 82 of the distributor plate 38. The fact that no bolts or holes extend through the upper surface 386 avoids the formation of any weak spots in the tungsten layer 342 thus further improving its resistance to wear and impact.

It will be appreciated that numerous modifications of the embodiments described above are possible within the scope of the appended claims.

The number of edges and thus the polygonal shape of the distributor plate may be varied to fit the rotor in question. For a rotor with three outflow openings a distributor with triangular or hexagonal shape is preferably used. A nonagonal shape is also possible. For a rotor with four outflow openings a distributor having square or octagonal shape is preferably used. A dodecagonal shape is also possible. A distributor plate having a number of side edges being two times the number of outflow openings is preferable since the distributor may be turned once for prolonged life. Triangular, square, hexagonal, octagonal, nonagonal and dodecagonal shapes all have the advantage of having only outwardly directed corners. This avoids the swirling of dust loaded air and the subsequent wear that may result from any inwardly directed corners. Further the hexagonal, octagonal and nonagonal shapes have corners with obtuse angles. Obtuse angles have the advantage of providing a distributor plate which is less sensitive to impacting rocks, which may more easily break a corner being right-angled or having an acute angle.

The lower surface 84 of the distributor plate 38 may, as described above with reference to FIG. 5, be located above the upper surfaces of the lower wear plates 14, 16, 18. For a rotor with a very low vertical height it may however be necessary, for reasons of maintaining the capacity for material passing through such a rotor, to locate the distributor plate 38 such that its lower surface 84 rests directly on the lower disc 4 of the rotor. In such a case the distributor plate 38 would need to be lifted somewhat such that its lower surface 84 comes above the upper surfaces of the wear plates 14, 16, 18 before the distributor plate 38 could be turned.

The invention claimed is:

1. A distributor plate releasably mounted on a horizontal lower disc of a rotor for a vertical shaft impact crusher, said rotor having an opening for the intake of material to be crushed and at least one outflow opening for material leaving the rotor, wherein a shape of the distributor plate is an equilateral polygon as seen from above, wherein the distributor plate has a lower surface and an upper surface, and wherein the upper surface comprises an unbroken layer.

2. The distributor plate according to claim 1, wherein the shape of the distributor plate is selected from the group consisting of triangular, square, hexagonal, octagonal and nonagonal shapes.

3. The distributor plate according to claim 1, wherein the number of sides of the polygon being chosen is selected such that the number of sides is 1, 2 or 3 times the number of outflow openings of the rotor to which the distributor plate is mounted.

4. The distributor plate according to claim 3, wherein the number of sides is 2 times the number of outflow openings of the rotor.

5. The distributor plate according to claim 1, wherein at least one straight side edge of the distributor plate is parallel to an outflow direction of material leaving the rotor and is parallel and adjacent to a face of a lower wear plate protecting the lower disc from wear.

6. The distributor plate according to claim 1, wherein the distributor plate at the center of its lower face has a recess to make the distributor plate horizontally turnable around a vertical shaft mounted on the lower disc, such that the position of the distributor plate in relation to the lower disc may be adjusted before mounting the distributor plate.

7. The distributor plate according to claim 6, wherein the recess extends only through a part of the thickness of the distributor plate, the upper face of the distributor plate thus being unaffected by said recess.

8. The distributor plate according to claim 6, wherein the distributor plate has a lower surface which is located at a higher level than the upper surface of lower wear plates protecting the lower disc of the rotor, such that the distributor plate may be adjusted without removing the lower wear plates.

9. The distributor plate according to claim 1, wherein the upper face of the distributor plate comprises an unbroken layer of a hard metal.

10. The distributor plate according to claim 9, wherein the upper face of the distributor plate comprises an unbroken layer of tungsten carbide.

11. The distributor plate according to claim 1, wherein the distributor plate comprises mounting means located at a vertical side edge of the distributor plate for mounting of a vertical support fixing the distributor plate to the lower disc of the rotor.

12. A distributor plate adapted to be releasably mounted on a horizontal lower disc of a rotor of a vertical shaft impact crusher, wherein a shape of the distribution plate is an equilateral polygon as seen from above, wherein the distributor plate has a lower surface and an upper surface, and wherein the upper surface comprises an unbroken layer.

13. The distributor plate according to claim 12, wherein the shape of the distributor plate is selected from the group consisting of triangular, square, hexagonal, octagonal, nonagonal, and dodecagonal shapes.

14. The distributor plate according to claim 12, further comprising a recess at the center of its lower face adapted to make the distributor plate horizontally turnable around a vertical shaft mounted on the lower disc, such that the position of the distributor plate in relation to the lower disc may be adjusted before mounting the distributor plate.

15. The distributor plate according to claim 14, wherein the recess extends only through a part of the thickness of the distributor plate, and wherein the upper face of the distribution plate is free of the recess.

16. The distributor plate according to claim 12, wherein the upper face of the distributor plate comprises an unbroken layer of a hard metal.

17. The distributor plate according to claim 12, wherein the upper face of the distributor plate comprises an unbroken layer of tungsten carbide.

18. The distributor plate according to claim 12, further comprising mounting means located at a vertical side edge of the distributor plate adapted for the mounting of a vertical support fixing the distributor to the lower disc of the rotor.

19. The distributor plate according to claim 18, wherein the mounting means comprises a hole with an inner thread adapted to receive a bolt.

* * * * *